United States Patent [19]

Huon De Kermadec et al.

[11] Patent Number: 4,716,838

[45] Date of Patent: Jan. 5, 1988

[54] TRANSPORT INSTALLATION COMPRISING A GUIDE TRACK AND A CAR PROVIDED WITH GRIPPING MEANS COOPERATING WITH A DRIVE CABLE

[75] Inventors: Jean Huon De Kermadec, Le Chesnay; Guy M. C. M. Thomas, Bagneres De Bigorre, both of France

[73] Assignee: Soule, Bagneres De Bigorre, France

[21] Appl. No.: 941,144

[22] Filed: Dec. 12, 1986

[30] Foreign Application Priority Data

Dec. 18, 1985 [FR] France ..... 85 18788

[51] Int. Cl.[4] ..... B61B 9/00

[52] U.S. Cl. ..... 104/173.1; 104/208

[58] Field of Search ..... 104/165, 173.1, 208, 104/211, 224, 229, 231, 232, 204, 233; 74/209; 188/83; 198/334, 792

[56] References Cited

U.S. PATENT DOCUMENTS

| | | | |
|---|---|---|---|
| 492,248 | 2/1893 | Walsh | 104/229 |
| 536,425 | 3/1895 | Hachenberg | 104/234 |
| 2,955,544 | 10/1960 | Goirand | 104/178 |
| 3,142,263 | 7/1964 | Craft | 104/229 |
| 3,871,303 | 3/1975 | Woodling | 104/173.1 |
| 4,512,259 | 4/1985 | Huon De Kermadec | 104/208 |
| 4,550,663 | 11/1985 | Deviaris | 104/173.1 |

FOREIGN PATENT DOCUMENTS

| | | | |
|---|---|---|---|
| 281550 | 8/1884 | Fed. Rep. of Germany | 104/173.1 |
| 5005 | of 1882 | United Kingdom | 104/229 |
| 1460106 | 12/1976 | United Kingdom | 104/173.1 |

*Primary Examiner*—Joseph F. Peters, Jr.
*Assistant Examiner*—Clifford T. Bartz
*Attorney, Agent, or Firm*—Perry Carvellas

[57] ABSTRACT

A transport installation comprises a guide track and at least one car which moves on the track. A circulating cable is provided near the track and a gripping device on the car grips this cable. This device comprises two gripping members movable relative to each other and urged into a closed position by a closing force developed within the car. A force distributor mechanism is disposed between at least one of these gripping members and the point at which the closing force is applied. Two force transmitting branches are coupled to the force distributor mechanism. Each transmits part of the aforementioned closing force. A first pivoting support carries one of the gripping members and has a first of these branches directly articulated to it. The othe branch is articulated to a second privoting support. On the second pivoting support are an engagement device and an abutment member. There is a first bearing surface on the first pivoting support with which this abutment member comes into contact when acted on by the part of the closing force applied to it by the second branch. It therefore urges the first pivoting support in the same direction as the first branch. There is at least one ramp member disposed in a fixed position along a predetermined section of the track. The engagement device co-operates with this ramp member so as to move the first and second pivoting supports apart.

13 Claims, 5 Drawing Figures

TRANSPORT INSTALLATION COMPRISING A GUIDE TRACK AND A CAR PROVIDED WITH GRIPPING MEANS COOPERATING WITH A DRIVE CABLE

BACKGROUND OF THE INVENTION

1. Field of the Invention

The invention concerns a transport installation comprising a guide track, such as a railroad track or the like, for example, and one or more cars adapted to move on this track and to be driven by a common cable circulating continuously in the vicinity of the track; the invention is more particularly concerned with the structure of gripping means carried by the car or cars to attach it or them to the cable.

2. Description of the Prior Art

There is a known transport installation using a car or cars able to accommodate a limited number of passengers (in the order of ten persons, for example) and designed to convey these passengers over average distances in the order of a few hundred meters. An installation of this kind is described in U.S. Pat. No. 4,512,259. In this installation a cable is driven continuously in a closed loop along the track and the car or cars are temporarily attached to it by the above mentioned gripping means in order to be driven from one point to another. The operating force applied to the gripping means is developed within the car or each car, but it is not always easily ajustable. This is the case in particular when the car comprises a cabin suspended above a chassis by a system forming weighing means and when the aforementioned gripping force is developed by this system and is representative of the weight of the cabin. A system of this kind is described in the aforementioned U.S. Pat. No. 4,512,259, for example. Conditioning the operating force for the gripping means to the weight of the vehicle is advantageous in that the accleration imparted to the car while it is being attached to the cable may be kept within predetermined limits irrespective of the number of passengers. Attachment to the cable may be achieved gradually by providing for some degree of relative displacement between the cable and the gripping means. The invention is most particularly concerned with an enhancement of this concept whereby the total gripping force may be applied in two stages so that initially the car moves off with moderate acceleration and the full gripping force is applied to the cable at a second stage when the speed of the car is substantially stabilized and equal to that of the cable, in order that the car may be firmly attached to the cable on grades.

SUMMARY OF THE INVENTION

The present invention consists in a transport installation comprising a guide track, at least one car adapted to move on said track, a circulating cable near said track, gripping means on said at least one car adapted to grip said cable and comprising two gripping members movable relative to each other and adapted to be urged into a closed position by a closing force developed within said at least one car, a force distributor mechanism disposed between at least one of said gripping members and a point at which said closing force is applied, two transmission branches coupled to said force distributor mechanism and each adapted to transmit part of said closing force, a first pivoting support to which the second branch is articulated, engagement means on said second pivoting support, an abutment member on said second pivoting support, a first bearing surface on said first pivoting support with which said abutment member is adapted to come into contact when acted on by the part of said closing force applied to it via said second branch so as to urge said first pivoting support in the same direction as said first branch, and at least one ramp member disposed in a fixed position along a predetermined section of said track, said engagement means being adapted to co-operate with said at least one ramp member so as to move apart said first and second pivoting supports.

It is to be understood that the invention is primarily applicable when the gripping force generated in each car is applied through the intermediary of a system forming weighing means whereby this force may be varied according to the number of passengers.

According to another advantageous feature of the invention, the same engagement means may be employed to secure total opening of the gripping means to enable to separate from the cable and the car to stop, as in a station, for example. In according with this advantageous characteristic, the aforementioned engagement means may be raised further if the aforementioned ramp is appropriately shaped so as to cause opening of the gripping means in this maximum raised position.

The invention will be better understood and other advantages of the invention will emerge more clearly from the following description of a currently preferred embodiment of a system in accordance with the invention, given by way of examply only and with reference to the appended drawings.

DESCRIPTION OF THE PREFERRED EMBODIMENT

Figure 1:
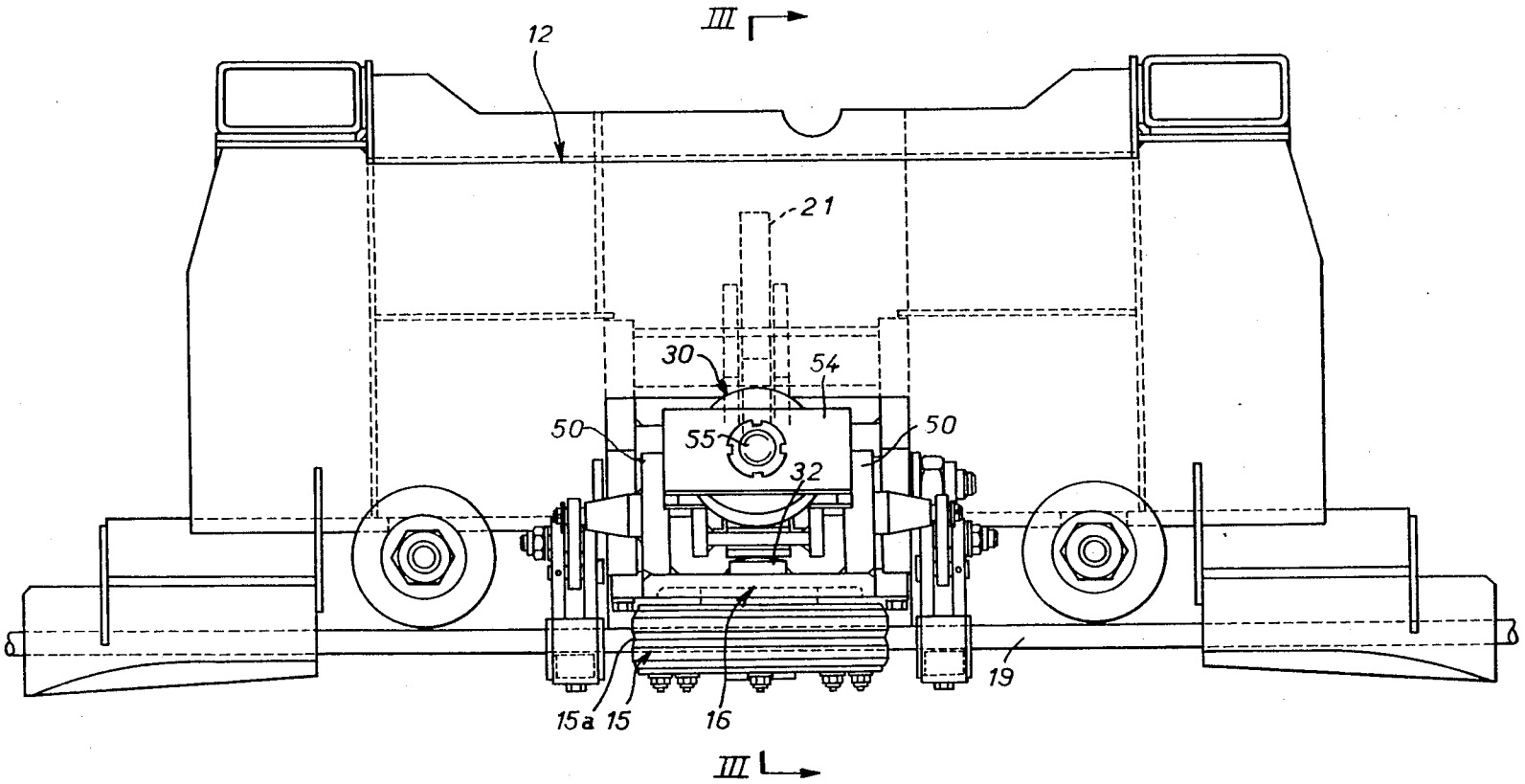
FIG. 1 is a schematic view in elevation of a lower part of the chassis of a car of the installation in accordance with the invention, showing in particular the gripping means co-operating with a drive cable.

Referring to the drawings, there is shown the lower part of a chassis 12 of a car adapted to move along a track (not shown), the chassis carrying gripping means 13 including two gripping members movable relative to each other, specifically in this instance a gripping member 14 mounted on the chassis 12 and a gripping member 15 mounted on a first pivoting support 16 in turn articulated on a first shaft 17 carried by the chassis 12. Rotation of the first pivoting support 16 in the clockwise direction in FIG. 3 results in closing of the gripping means, that is to say movement of the gripping member 15 towards the gripping member 14, so gripping the traction cable 19 by which the car is driven along the track. In the example being described, both gripping members 14 and 15 are braked wheels, that is to say wheels comprising internally friction facings urged at all times against a mobile surface (this conventional arrangement not being shown in the drawings) so that the wheel can be driven in rotation to which it opposes a braking force. Consequently, the wheel 14 can turn about its axis relative to the chassis 12 while the wheel 15 can turn about its axis relative to the pivoting support 16. The gripping means and in particular the pivoting support 16 are articulated so as to apply the rolling surface of the wheel 15 against the rolling surface of the wheel 14, the cable being accommodated between them, to be more precise, between two circular grooves 14a, 15a defined on the respective rolling surfaces of the wheels. The wheels are surfaced with rubber, polyurethane or the like.

The gripping means 13 are closed by a force F generated within the car and applied to a control link 21. As previously mentioned, this force F is developed by a system forming means for weighing a cabin suspended above the chassis 12, as described in the aforementioned US patent, for example. Thus the traction force F exerted on the link 21 is representative of the weight of the cabin, which means that it varies according to the number of passengers.

Figure 3:
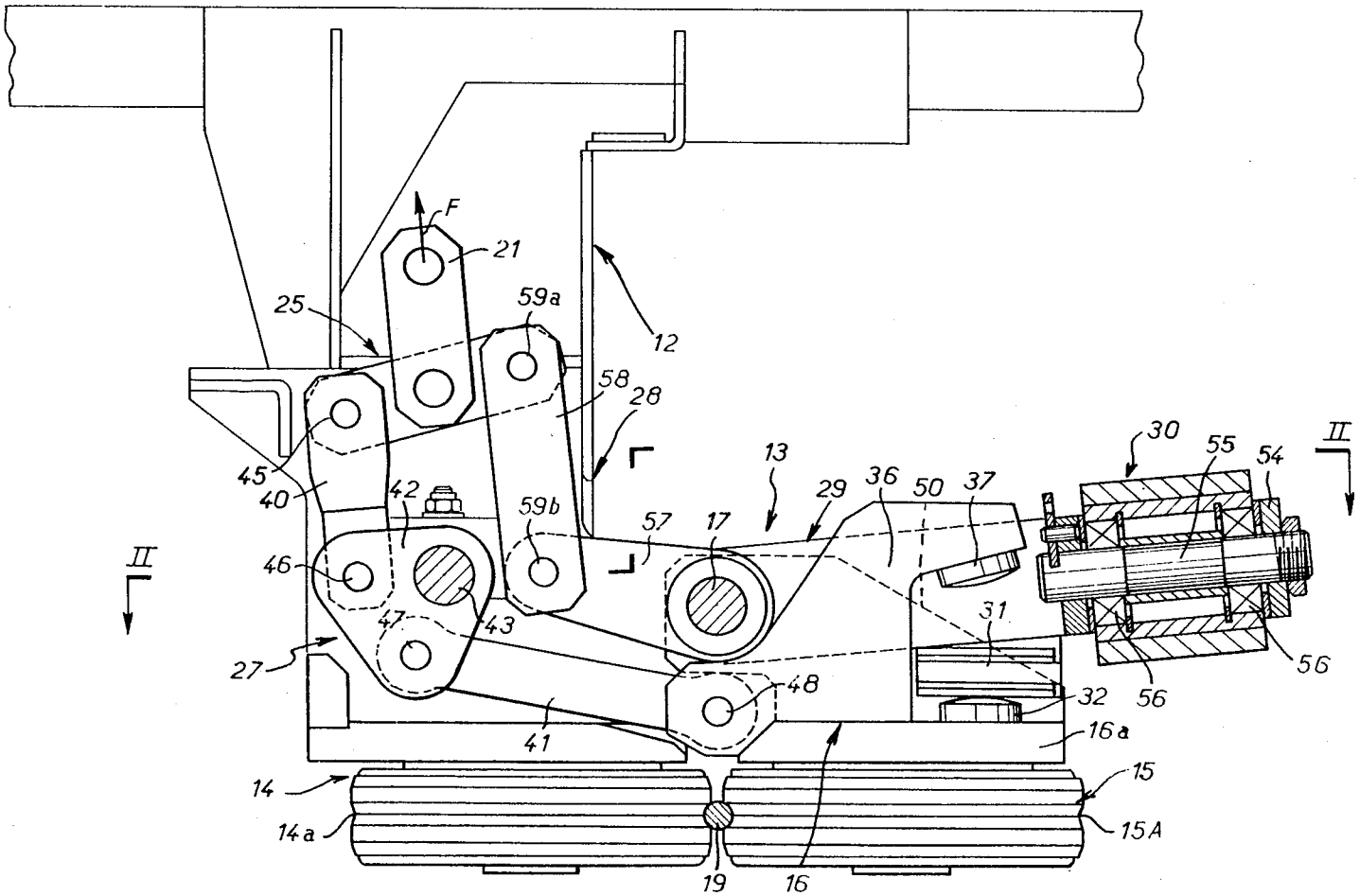
FIG. 3 is a partial view in cross-section on the line III—III in FIG. 2.

In accordance with an important characteristic of the invention, the gripping means 13 comprise a force distributor mechanism in the form of a rocking lever 25 suspended from the link 21 and articulated to two transmission branches extending between respective ends of the rocking lever and the gripping member 15. Thus the rocking lever transmits part of the force F to each branch. A first branch 27 is articulated directly to the first pivoting support 16 while a second branch 28 is articulated to a second pivoting support 29 comprising engagement means 30 and an abutment member 31 adapted to come into contact with a stud forming a first bearing surface 32 on the first pivoting support 16. The second pivoting support 29 is mounted to pivot on the first shaft 17. The arrangement is therefore such that, when acted on by the part of the force F that is applied to it by the second branch 28, the abutment member 31 comes into contact with the bearing surface 32 and therefore urges the first pivoting support in the same direction as the first branch 27. This is the situation as shown in FIG. 3 in particular. In this case, all of the force F is used to grip the cable 19. This is the normal state of the gripping means when the car is moving between two stations. In this situation the engagement means 30 do not co-operte with any structural member fixed relative to the track.

On the other hand, at locations where the cabin is to be joined onto the cable, that is to say notably below the lip of a departure platform, a ramp member 35 fixed relative to the track is adapted to co-operate with the engagement means 30 so as to at least separate said first and second pivoting supports and so cancel out the contribution to the gripping force of that part of the force F which is transmitted by the branch 28. This is the situation illustrated in FIG. 4.

The first pivoting support 16 comprises an upper extension 36 carrying another stud forming a second bearing surface 37 spaced from the surface 32 and the abutment member 31 fastened to the second pivoting support 29 is mounted so as to be able to move between the bearing surfaces 32 and 37. It will thus be understood that if the engagement means 30 are sufficiently raised the abutment member 31 can come into contact with the bearing surfce 37 and hold the gripping means open. This is the situation illustrated in FIG. 5.

Thus when the car arrives at a station where it is necessary to separate the car from the cable so that the car may be effectively braked to a halt, the engagement means 30 encounter a ramp member such as the member 35 fixed relative to the track and which raises the second pivoting support 29 sufficiently for the abutment member 31 to be able in its turn to co-operate with the bearing surface 37 on the first pivoting support in order to tilt it back and so release the cable 19.

Figure 4:
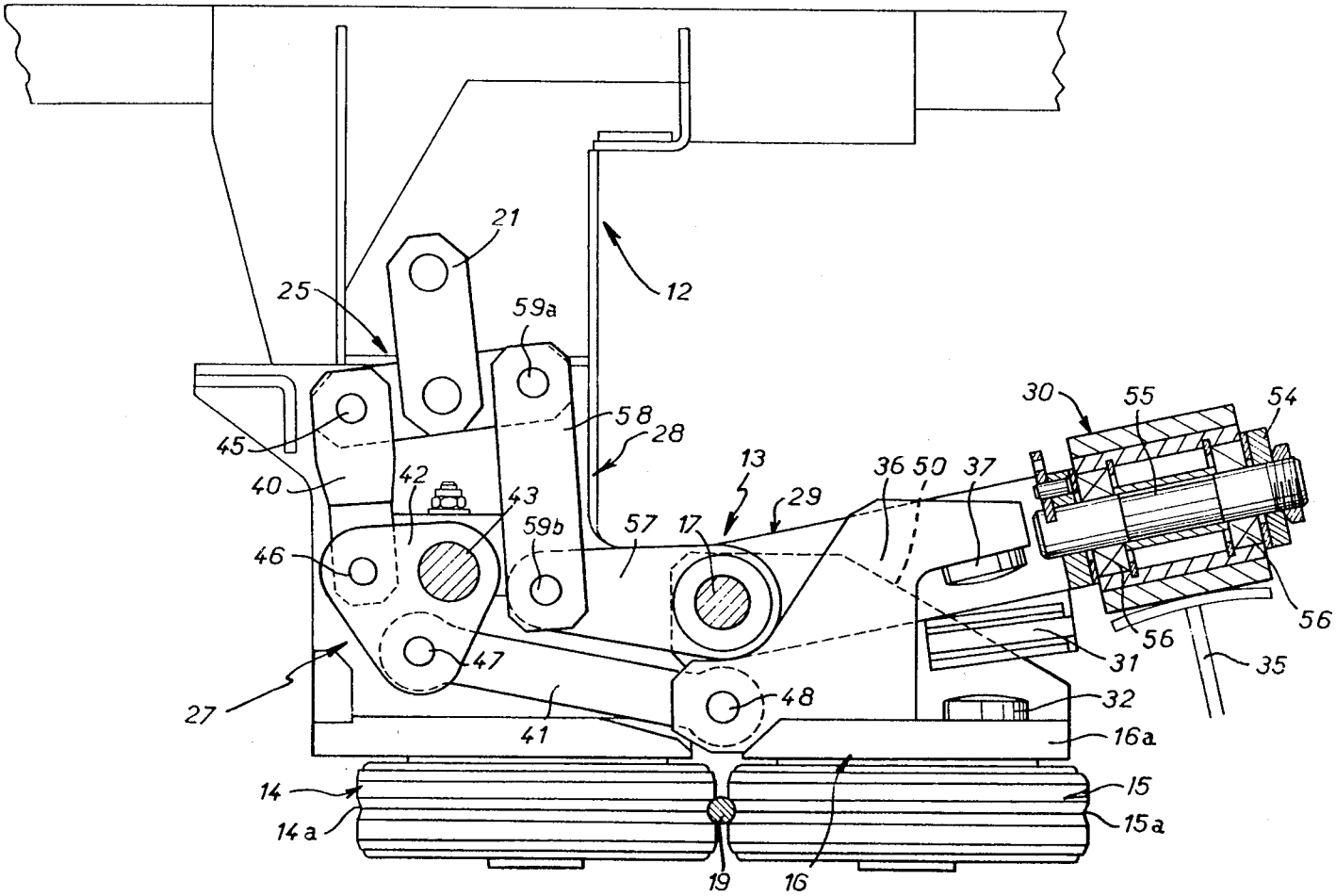
FIG. 4 is a view analogous to FIG. 3 showing the gripping means in an intermediate gripping position.
Figure 5:
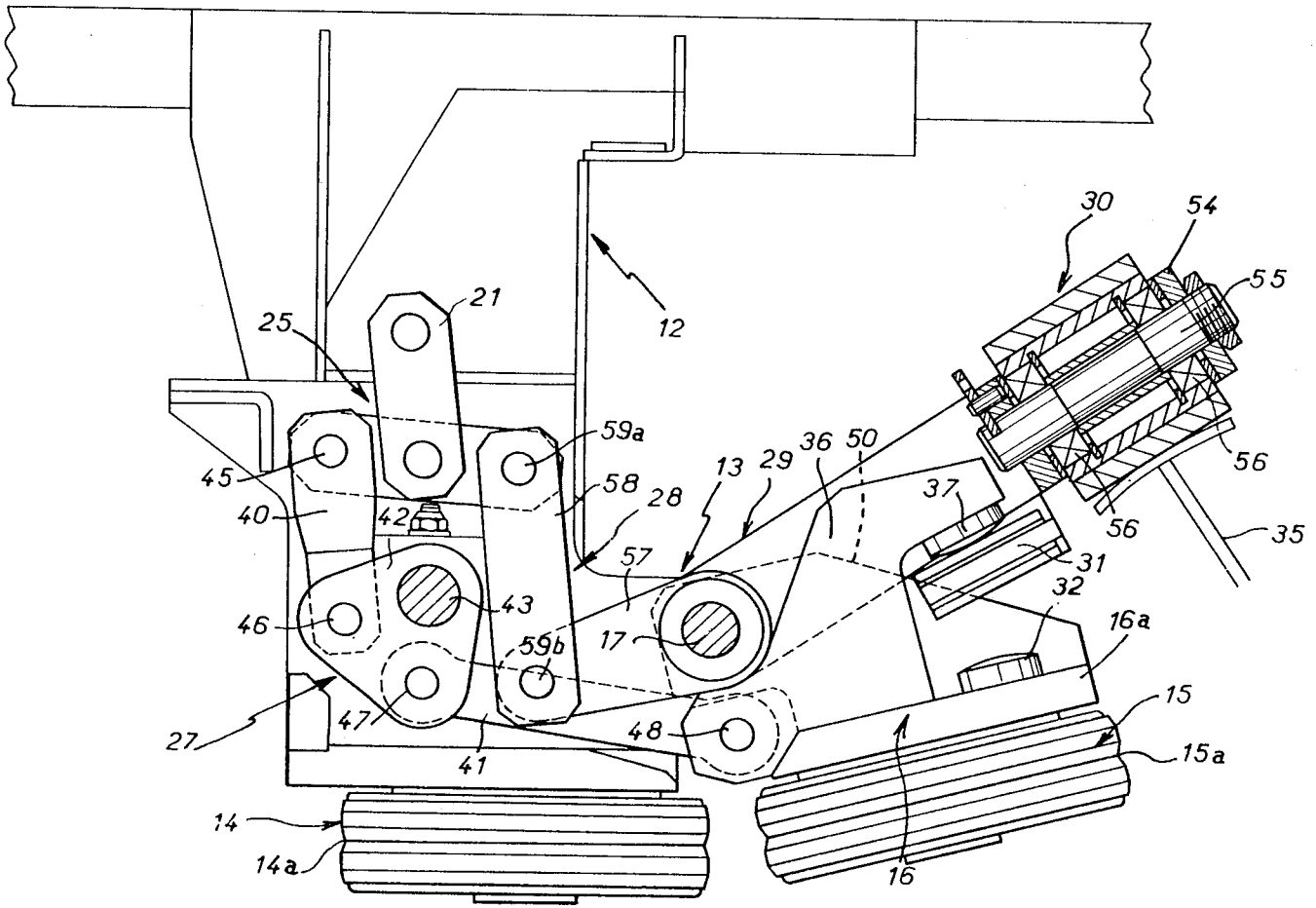
FIG. 5 is a view analogous to FIG. 3 showing the gripping means open.

On leaving a station, on the other hand, the engagement means 30 co-operate with another ramp member like the member 35 which extends between at least two predetermined levels (becoming gradually lower in the direction of movement) successively corresponding to the profile illustrated in FIG. 5 and then to the profile illustrated in FIG. 4. While the ramp is as shown in FIG. 5, the gripping means remain open and the cable 19 is guided into a position between the gripping members 14 and 15. The ramp then drops down to a second level (FIG. 4) in which the abutment member 31 is released from the bearing surface 37 but is not yet in contact with the bearing surface 32. The cable 19 is therefore gripped between the gripping members 14 and 15 but the gripping force communicated to the pivoting support 16 represents only part of the force F, namely that transmitted by the first branch 27 of the gripping means. The ramp member 35 then gets lower along the path of the car until the abutment member 31 comes into contact with the bearing surface 32. From this moment all of the force F communicated to the gripping means 13 contributes to gripping of the cable 19 between the gripping members 14 and 15. This is the situation illustrated in FIG. 3.

Figure 2:
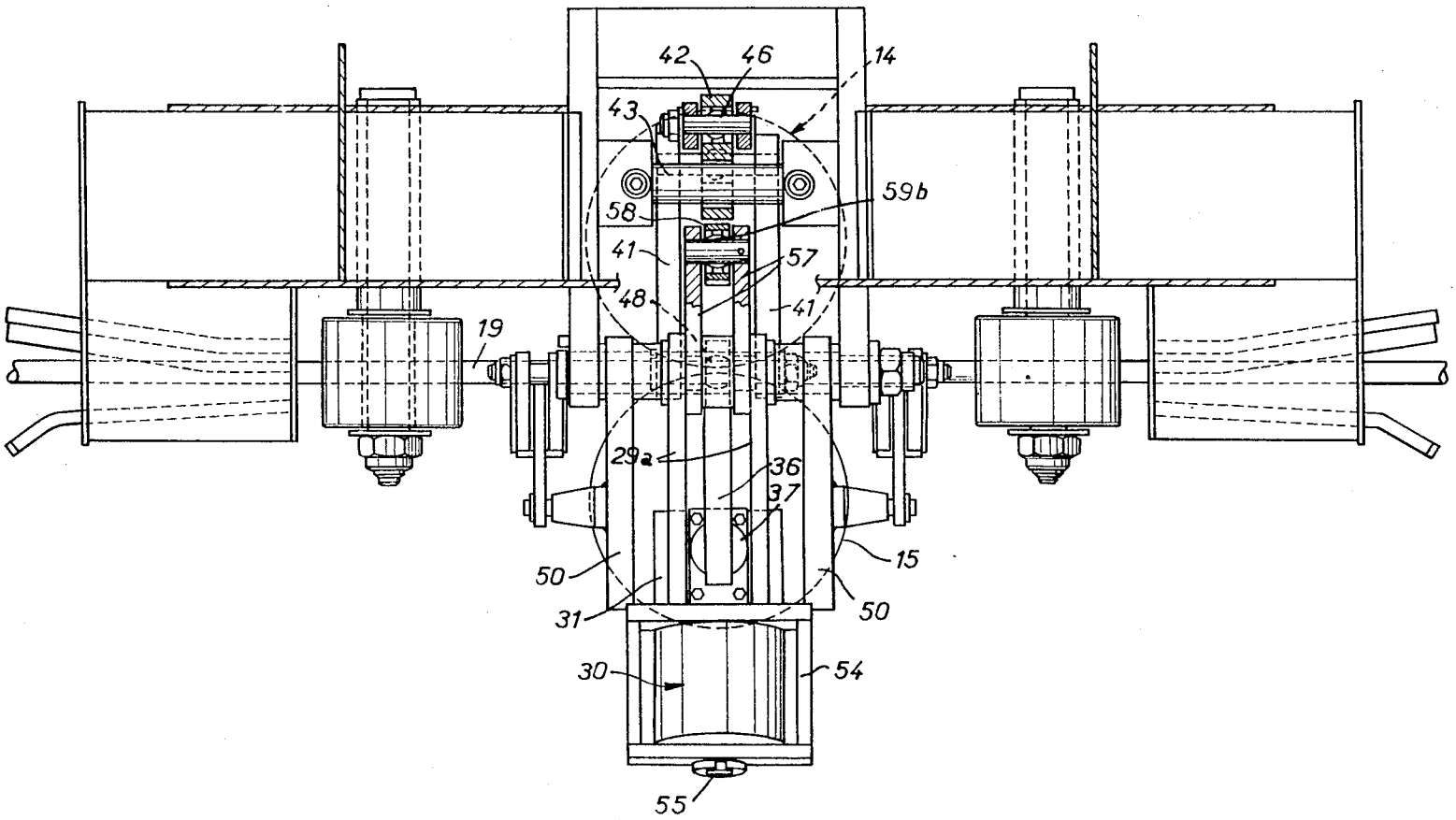
FIG. 2 is a plan view in partial cross-section on the line II—II in FIG. 3 of the same part of the installation.

Returning now to FIGS. 1 through 3 in particular, the principal component parts of the gripping means 13 will be described in more detail. In particular, the first branch 27 comprises two members 40 and 41 forming links and a connecting member 42 mounted to pivot on a second shaft 43 carried by the chassis 12. The shaft 43 is parallel to the shaft 17. The element 40 is articulated between one end of a rocking lever 25, by means of a pivot pin 45, and its other end is formed as a yoke in order to be articulated by a pivot pin 46 to the connecting member 42. The link member 41 is of generally rectangular shape each of the two shorter sides of which carries a respective pivot pin 47, 48 at the center. The pivot pin 47 articulates the member 41 to the connecting member 42 while the pivot pin 48 articulates the member 41 to the first pivoting support 16. This comprises two flanges 50 by means of which it is fixed to the shaft 17. The flanges are linked by a lower base member 16a carrying the clamping member 15 and the first bearing surface 32.

The second pivoting support 29 essentially comprises two parallel arms 29a mounted at one end on the shaft 17 and carrying the abutment member 31 as well as a frame 54 through which extends a shaft 55 carrying the engagement means 30. This is in the form of a roller mounted to rotate on the shaft 55 through the intermediary of ball bearings 56. On the other side of the shaft 17 the second pivoting support 29 is extended by a lever 57 itself formed by two parallel arms constituting a yoke. The aforementioned second branch 28 is formed by a link member 58 articulated by a pivot pin 59a to the other end of the rocking lever 25 and by a pivot pin 59b to the lever 57.

There is claimed:

1. Transport installation comprising a guide track, at least one car adapted to move on said track, a circulating cable near said track, gripping means on said at least one car adapted to grip said cable and comprising two gripping members movable relative to each other and adapted to be urged into a closed position by a closing force developed within said at least one car, a force distributor mechanism disposed between at least one of said gripping members and a point at which said closing force is applied, two transmission branches coupled to said force distributor mechanism and each adapted to transmit part of said closing force, a first pivoting support to which the second branch is articulated, a second pivoting support engagement means on said second pivoting support, an abutment member on said second pivoting support, a first bearing surface on said first pivoting support with which said abutment member is adapted to come into contact when acted on by the part of said closing force aplied to it via said second branch so as to urge said first pivoting support in the same direction as said first branch, and at least one ramp member disposed in a fixed position along a predetermined section of said track, said engagement means being adapted to co-operate with said at least one ramp member so as to move apart said first and second pivoting supports.

2. Transport installation according to claim 1, wherein said first pivoting support comprises an extension which has at one end a second bearing surface, said abutment member on said second pivoting support is adapted to move between said first and second bearing surfaces, and said at least one ramp member extends between at least two predetermined levels at each of which it co-operates with said engagement means, namely a first level at which said abutment member is disengaged from said first and second bearing surfaces and a second level at which said abutment member co-operates with said second bearing surface to hold said gripping members apart.

3. Transport installation according to claim 1, wherein said gripping members are braked wheels and said gripping means are articulated in such a way that said closing force urges said braked wheels into contact with each other via their rolling surfaces with said cable gripped between them.

4. Transport installation according to claim 3, wherein each of said wheels has a groove in its rolling surface and said cable is accommodated in the combination of said two grooves.

5. Transport installation according to claim 1, wherein said car has a chassis and further comprising a first shaft mounted on said chassis, one of said gripping members being fastened to said chassis and the other of said gripping members being mounted on said first pivoting support which is mounted on said first shaft.

6. Transport installation according to claim 5, wherein said second pivoting support is mounted on said first shaft.

7. Transport installation according to claim 5, further comprising a rocking lever and wherein a second shaft is mounted on said chassis parallel to said first shaft, said first branch comprises two link members and a connecting member pivoted on said second shaft, one of said link members is articulated between one end of said rocking lever and said connecting member and the other link member is articulated between said connecting member and said first pivoting support.

8. Transport installation according to claim 1, further comprising a rocking lever and wherein said second pivoting support comprises a lever and said second branch comprises a link member articulated between one end of said rocking lever and said lever.

9. Transport installation according to claim 1, wherein said engagement means comprise a shaft fastened to said second pivoting support and a roller mounted on said shaft.

10. Transport installation according to claim 1, wherein said car comprises a chassis, a cabin and a system for weighing said cabin by which said cabin is suspended from said chassis and which is adapted to generate said closing force which is a traction force proportional to the weight of said cabin.

11. Transport installation according to claim 1, wherein said force distributor mechanism is a rocking lever.

12. Transport installation according to claim 1, wherein said ramp member is disposed near a departure platform.

13. Transport installation according to claim 9, further comprising ball bearings by which said roller is mounted on said shaft.

* * * * *